US006757514B2

(12) United States Patent
Berkes et al.

(10) Patent No.: US 6,757,514 B2
(45) Date of Patent: Jun. 29, 2004

(54) HIGH-SPEED HEAT AND PRESSURE BELT FUSER

(75) Inventors: John S. Berkes, Webster, NY (US); Donald M. Bott, Rochester, NY (US); Anthony S. Condello, Webster, NY (US)

(73) Assignee: Xerox Corporation, Stamford, CT (US)

( * ) Notice: Subject to any disclaimer, the term of this patent is extended or adjusted under 35 U.S.C. 154(b) by 71 days.

(21) Appl. No.: 10/217,683

(22) Filed: Aug. 12, 2002

(65) Prior Publication Data

US 2004/0028433 A1 Feb. 12, 2004

(51) Int. Cl.[7] ..... G03G 15/20
(52) U.S. Cl. ..... 399/329; 399/328; 399/333
(58) Field of Search ..... 219/216; 399/302, 399/307, 328, 329, 331, 333

(56) References Cited

U.S. PATENT DOCUMENTS

| | | | |
|---|---|---|---|
| 4,242,566 | A | 12/1980 | Scribner |
| 4,582,416 | A | 4/1986 | Karz et al. |
| 4,992,304 | A | 2/1991 | Titterington |
| 5,250,998 | A | 10/1993 | Ueda et al. |
| 5,349,424 | A | 9/1994 | Dalal et al. |
| 5,465,146 | A | 11/1995 | Higashi et al. |
| 5,729,812 | A | 3/1998 | Moser |
| 5,890,047 | A | 3/1999 | Moser |
| 5,983,048 | A | 11/1999 | Moser |
| 6,088,565 | A | 7/2000 | Jia et al. |
| 6,246,858 | B1 | 6/2001 | Condello et al. |
| 6,393,245 | B1 | 5/2002 | Jia et al. |

OTHER PUBLICATIONS

USSN 10/093,263, filed on Mar. 8, 2002, entitled "Externally Heated Thick Belt Fuser," by Anthony S. Condello, et al.

*Primary Examiner*—Hoang Ngo
(74) *Attorney, Agent, or Firm*—Ben Sklar

(57) ABSTRACT

A high speed heat and pressure belt fuser apparatus or structure for fixing toner images including an endless belt and a pair of pressure members between which the endless belt is sandwiched for forming a fusing nip through which substrates carrying toner images pass with the toner images contacting an outer surface of the endless belt. Thus, one of the pressure rolls is supported internally of the endless belt while the other pressure roll is supported externally of the belt. The belt has at least one conformable or deformable layer which cooperates with a deformable or conformable layer on at least one of the pressure members to provide a large nip that yields high gloss images, long belt life, minimal edge wear and reliable stripping at high speeds. Effective substrate stripping is accomplished by wrapping a portion of the belt about the external roll in a post-nip area.

16 Claims, 8 Drawing Sheets

| CONFIGURATIONS -> | | R15(45)xB3(48) ORIGINAL (X3) | R0xB3(48) (~X5) | R5(70)xB4.5(48) | R7(45)xB4.5(48) POSSIBLE | R5(45)xB4.5(48) POSSIBLE | R5(70)xB3(48) PREFERRED (X4) |
|---|---|---|---|---|---|---|---|
| IPR RUBBER | THICKNESS | 15 mm | 0 mm | 5 mm | 7 mm | 5 mm | 5 mm |
| | SHOREA | 45 | na | 70 | 45 | 45 | 70 |
| BELT | THICKNESS | 3 mm | 3 mm | 4.5mm | 4.5mm | 4.5mm | 3mm |
| | SHOREA | 48 | 48 | 48 | 48 | 48 | 48 |
| FUSING NIP | WIDTH | 19 mm | 12 mm | 17 mm | 18 mm | 17.5 mm | 14 mm |
| | PRESSURE | 80 psi | 125 psi | 100psi | 100psi | 100psi | 110 psi |
| CREEP | MEASURED | -1.7% | 12% | 11.3% | 5% | 6.5% | 6.2% |
| MAX SPEED @ 30 MS | mm/s | 633 mm/s | 400 mm/s | 567 mm/s | 600 mm/s | 585 mm/s | 467 mm/s |
| | ppm | 135 ppm | 85 ppm | 121 ppm | 128 ppm | 125 ppm | 100 ppm |
| DWELL @ | 265 mm/s | 72 ms | 45 ms | 64 ms | 68 ms | 66 ms | 53 ms |
| | 352 mm/s | 54 ms | 34 ms | 48 ms | 51 ms | 50 ms | 40 ms |
| | 468 mm/s | 40 ms | 26 ms | 36 ms | 38 ms | 37 ms | 30 ms |
| FUSING NIP WIDTH | | LARGE NIP | SMALL NIP | LARGE NIP | LARGE NIP | LARGE NIP | MEDIUM NIP |
| CREEP | | LOW CREEP | HIGH CREEP | HIGH CREEP | MEDIUM CREEP | MEDIUM CREEP | MEDIUM CREEP |
| PAPER EDGE ABRASION | | LOW | HIGH | HIGH | MEDIUM | MEDIUM | MEDIUM |
| PAPER STRIPPING | | POOR | EXCELLENT | EXCELLENT | GOOD | GOOD | GOOD |
| BELT LIFE | | EXCELLENT | POOR | POOR | GOOD | GOOD | GOOD |

FIG. 3

HIGH-SPEED HEAT AND PRESSURE BELT FUSER

BACKGROUND OF THE INVENTION

This invention relates generally to electrostatographic imaging, and more particularly, it relates to a high-speed heat and pressure belt fusing apparatus for fixing images to a final substrate that exhibits long belt life, minimal edge wear and reliable stripping.

In a typical electrophotographic copying or printing process, a charge retentive surface such as a photoconductive member is charged to a substantially uniform potential so as to sensitize the surface thereof. The charged portion of the photoconductive member is selectively exposed to light to dissipate the charges thereon in areas subjected to the light. This records an electrostatic latent image on the photoconductive member. After the electrostatic latent image is recorded on the photoconductive member, the latent image is developed by bringing one or more developer materials into contact therewith. Generally, the developer material comprises toner particles adhering triboelectrically to carrier granules. The toner particles are attracted from the carrier granules either to a donor roll or to a latent electrostatic image on the photoconductive member. When attracted to a donor roll the toner particles are subsequently deposited on the latent electrostatic images. The toner powder image is then transferred from the photoconductive member to a final substrate. The toner particles forming the toner powder images are then subjected to a combination of heat and/or pressure to permanently affix the powder images to the copy substrate.

In order to fix permanently or fuse the toner material onto a substrate or support member such as plain paper by heat, it is necessary to elevate the temperature of the toner material to a point at which constituents of the toner material coalesce and become tacky. This action causes the toner to flow to some extent onto the fibers and/or into the pores of the support member or otherwise upon the surface thereof. Thereafter, as the toner material cools, solidification of the toner material occurs causing the toner material to be bonded firmly to the support member.

One approach to thermal fusing of toner material images onto the final substrate has been to pass the substrate with the unfused toner images thereon between a pair of opposed roller members, at least one of which is internally heated. During operation of a fusing system of this type, the substrate to which the toner images are electrostatically adhered is moved through a nip formed between the pressure engaged rolls with the toner image contacting the heated fuser roll to thereby effect heating of the toner images within the nip. In a Nip Forming Fuser Roll (NFFR), the heated fuser roll is provided with a layer or layers that are deformable (i.e. conformable) by a harder pressure roll when the two rolls are pressure engaged. The length of the nip determines the dwell time or time that the toner particles remain in contact with the surface of the heated roll, the dwell time being also determinative of the fuser's speed.

The layer or layers usually comprise an abhesive (low surface energy) material for preventing toner offset to the fuser member. Three materials, which are commonly used for such purposes, are fluoropolymers, fluoroelastomers and silicone rubber.

Roll fusers work well for fusing color images at lower speeds since the required process conditions such as temperature, pressure and dwell can be achieved. When process speeds approach faster speeds, for example 100 pages per minute (ppm), roll fusing performance is no longer acceptable. As fusing speed increases, dwell time must be maintained above a minimum, which means an increase in nip length. Increasing the nip length can be accomplished either by increasing the fuser roll rubber thickness, and/or reducing the modulus and/or increasing the outside diameter of the roll. However, each of these solutions reach their maximum effectiveness at about 100 ppm. Specifically, for an internally heated fuser roll, the fuser roll deformable layer thickness is limited by the maximum temperature the material forming the layers can withstand, and the thermal gradient across the layer. The roll size also becomes a critical issue for reasons of space, weight, cost and substrate stripping therefrom.

In order to obtain much higher fusing speeds than heretofore possible for color xerography, very large or long fusing nips are necessary. One way to achieve longer fusing nips for this purpose is to use a thick deformable belt instead of a fuser roll with a thick deformable layer or layers. Due to poor thermal conductivity, however, it is necessary to heat the outer surface of a thick elastomer belt over an extended contact zone using a source of thermal energy. To create a long, nip for extending fusing dwell time, it is desired that the belt be as thick as possible. However, belt flexibility can be compromised with relatively large belt thicknesses. Additional nip length can also be obtained using an elastomeric layer or layers on a pressure roll that contact the internal surface of the thick belt. The thicknesses of the elastomers on the pressure roll and the fuser belt along with other characteristics of the elastomers such as Shore A hardness contribute to the desired characteristics of the fusing nip. The thickness and the durometer of both elastomers can be varied to obtain the desired dwell times in the fusing nip.

One problem with a belt and roll arrangement that yields the desired nip length and thus the desired higher fusing speeds is that the creep is so low that substrate stripping from the belt without a separate stripping device is impossible. Creep is defined as the % velocity difference of the fuser belt surface in the fusing nip compared to its speed outside the nip.

Therefore, it is desired to provide a combination high-speed (i.e. above 100 ppm) belt and roll fuser for fusing color toner images that exhibit high gloss with minimal edge wear and long belt life and reliable substrate stripping.

Following is a discussion of references that may bear on the patentability of the present invention. In addition to possibly having some relevance to the question of patentability, these references, together with the detailed description of the present invention to follow, may provide a better understanding of the invention. The references that are discussed herein are hereby incorporated by reference in their entirety.

U.S. patent application Ser. No. 10/093,263 filed on Mar. 8, 2002, assigned to the same assignee as the present invention discloses a heat and pressure belt fuser structure having an endless belt and a pair of pressure engageable members between which the endless belt is sandwiched for forming a fusing nip through which substrates carrying toner images pass with the toner images contacting an outer surface of the endless belt, at least one of the pressure engageable members has one or more deformable layers, and the endless belt has a thickness of from about 1 to about 8 mm; and the fuser structure includes an external source of thermal energy for elevating a pre-nip area of the belt. The thick belts in combination with a deformable layer of at least one of the pressure member(s) cooperate to provide a large nip and adequate creep for intrinsic paper stripping. A creep value less than a predetermined value prevents stripping.

U.S. Pat. No. 5,890,047 granted to Rabin Moser on Mar. 30, 1999 discloses a combination belt and roll fuser has a pair of pressure engageable rolls with a belt looped or wrapped around one of the pressure engageable rolls such that the belt is sandwiched between the two rolls. The belt is deformed due to the force exerted by the pressure rolls such that it forms a single fusing nip. Substrates carrying toner images pass through the single fusing nip with the toner images contacting the outer surface of the belt. An internally heated, thermally conductive roll contacts a portion of the belt externally at a pre-nip location for elevating its temperature of the belt. The pressure engageable roll about which the belt is entrained is internally heated during warm-up for minimizing a phenomenon known as droop. This belt and roll fuser configuration exhibits the characteristics of a Nip Forming Fuser Roll (NFFR) fuser as discussed above.

U.S. Pat. No. 6,088,565 granted to Jia et al on Jul. 11, 2000 discloses a transfuse system that discusses the concept of fuser belt creep and states that the preferred creep is greater than 4%.

U.S. Pat. No. 6,246,858 discloses an electrostatographic reproduction machine that includes a fuser belt moving or position changing mechanism for moving the fuser belt and controllably changing its position axially relative to a plurality of rollers supporting the belt for movement in an endless path. The belt moving mechanism is suitable for controllably moving the endless fusing belt axially, (relative to the plurality of rollers) from a first fusing position to at least a second fusing position so as to reduce sheet edge wear in the same spot on the external fusing surface of the endless fusing belt.

U.S. Pat. No. 5,983,048 a temperature droop compensated NFFR fuser having a preheater structure which conveys the substrate carrying toner images past a radiant heat contained therein and then into the nip of a pair of pressure engaged fuser rollers that form the NFFR fuser. One of the fuser rollers is heated by an internal heater that is supplied a constant level of power that generally maintains the temperature of the heated roller to a temperature sufficient to fuse the toner images on the substrate. The preheater structure warms the substrate carrying toner images prior to entry into the nip of the fuser rollers to compensate for the temporary temperature droop of the fuser rollers that is encountered when the fuser moves from a standby mode to an operating mode. The combination of pre-warmed substrate and the temperature to which the heated fuser roller droops is sufficient to completely fuse the toner images on the substrate. With time in the operating mode, the fuser rollers recover from droop and the radiant heat source in the preheater structure is turned off.

U.S. Pat. No. 6,393,245 granted to Jia et al on May 21, 2002 relates to a transfuse system wherein stripping of substrates is assisted by the positioning of one guide roller supporting an intermediate transfuse belt relative to another guide roller.

U.S. Pat. No. 5,729,812 granted Mar. 17, 1998 relates to a combination dual hard roll and dual elastomeric belt fuser. A pair of hard, heated fuser rolls having elastomeric belts entrained thereabout are supported such that segments of the belts are sandwiched in a nip area therebetween. The belt segments are sufficiently thick to provide belt conformability resulting in high quality fused images. One of the belts is partially wrapped about one of the rigid rolls to form an extended heating zone and a combination heat and pressure zone through which substrates carrying toner images are moved.

U.S. Pat. No. 4,242,566 granted to Albert W. Scribner on Dec. 30, 1980 discloses a heat and pressure fusing apparatus that exhibits high thermal efficiency. The fusing apparatus comprises at least one pair of first and second oppositely driven pressure fixing feed rollers, each of the rollers having an outer layer of a thermal insulating material; first and second idler rollers, a first flexible endless belt disposed about the first idler roller and each of the first pressure feed rollers and a second flexible endless belt disposed about the second idler roller and each of the second pressure feed rollers, at least one of the belts having an outer surface formed of a thermal conductive material, wherein there is defined an area of contact between the outer surfaces of the first and second belts located between the first and second pressure feed rollers for passing the copy sheet between the two belts under pressure; and means spaced relative to the belt whose outer surface comprises the thermal conductive material for heating the outer surface thereof, whereby when an unfused copy sheet is passed through the area of contact between the two belts it is subject to sufficient heat and pressure to fuse developed toner images thereon.

U.S. Pat. No. 4,582,416 granted to Karz et al on Apr. 15, 1986 discloses a heat and pressure fusing apparatus for fixing toner images. The fusing apparatus is characterized by the separation of the heat and pressure functions such that the heat and pressure are effected at different locations on a thin flexible belt forming the toner-contacting surface. A pressure roll cooperates with a stationary mandrel to form a nip through which the belt and copy substrates pass simultaneously. The belt is heated such that by the time it passes through the nip its temperature together with the applied pressure is sufficient for fusing the toner images passing through.

U.S. Pat. No. 4,992,304 granted to Gilbert et al on May 1, 1990 discloses a fuser belt for a reproduction machine. The belt may have one of several configurations which all include ridges and interstices on the outer surface which contacts the print media. These interstices are formed between regularly spaced ridges, between randomly spaced particles, between knit threads. These interstices allow the free escape of steam from the media during high-temperature fusing of the reproduction process. As the steam escapes freely, the steam does not accumulate in the media causing media deformations and copy quality deterioration. Additionally, media handling is improved because the ridges and interstices reduce the unwanted but unavoidable introduction of thermal energy into the copy media.

U.S. Pat. No. 5,250,998 granted to Ueda et al on Oct. 5, 1993 discloses a toner image fixing device wherein there is provided an endless belt looped up around a heating roller and a conveyance roller, a pressure roller for pressing a sheet having a toner image onto the heating roller with the endless belt intervening between the pressure roller and the heating roller. A sensor is disposed inside the loop of the belt so as to come in contact with the heating roller, for detecting the temperature of the heating roller. The fixing temperature for the toner image is controlled on the basis of the temperature of the heating roller detected by the sensor. A first nip region is formed on a pressing portion located between the heating roller and the fixing roller. A second nip region is formed between the belt and the fixing roller, continuing from the first nip region but without contacting the heating roller.

U.S. Pat. No. 5,349,424 granted to Dalal et al on Sep. 20, 1994 discloses a heated, thick-walled, belt fuser for an electrophotographic printing machine. The belt is rotatably supported between a pair of rolls. One of the spans of the belt is in contact with a heating roll in the form of an aluminum roll with an internal heat source such as a quartz lamp. The belt is able to wrap a relatively large portion of the heating roll to increase the efficiency of the heat transfer. The second span of the belt forms an extended fusing nip with a pressure roll. The extended nip provides a greater dwell time for a sheet in the nip while allowing the fuser to operate at a greater speed. External heating enables a thick profile of the belt, which in turn allows the belt to be reinforced so as to operate at greater fusing pressures without degradation of the image. The thick profile and external heating of the belt also provides a much more robust design than conventional thin walled belt fusing systems.

U.S. Pat. No. 5,465,146 granted to Hgashi et al on Nov. 7, 1995 relates to a fixing device to be used in electrophotographic apparatus for providing a clear fixed image with no offset with use of no oil or the least amount of oil, wherein an endless fixing belt provided with a metal body having a release thin film thereon is stretched between a fixing roller having a elastic surface and a heating roller, a pressing roller is arranged to press the surface of the elastic fixing roller upwardly from the lower side thereof through the fixing belt to form a nip portion between the fixing belt and the pressing roller, a guide plate for unfixed image carrying support member is provided underneath the fixing belt, between the heating roller and the nip portion, to form substantially a linear heating path between the guide plate and the fixing belt, and the metal body of the fixing belt has a heat capacity per cm2 within the range of 0.001 to 0.02 cal/° C.

BRIEF SUMMARY OF THE INVENTION

The present invention provides a high speed heat and pressure belt and roll fuser structure comprising: a plurality of members including a deformable (i.e. conformable) endless belt and a pair of pressure rolls between which the endless belt is sandwiched for forming a fusing nip through which substrates carrying toner images pass with the toner images contacting an outer surface of the endless belt. Thus, one of the pressure members is positioned internally of the endless belt while the other one is positioned externally thereof. The internal pressure member comprises at least one deformable (i.e. conformable) layer and the belt comprises at least one deformable (i.e. conformable) outer layer.

An external source of thermal energy is provided for elevating a pre-nip area of the belt. The fuser of the present invention provides a high speed fuser with inherent glossing, minimal edge wear, long belt life and reliable substrate stripping the latter of which is provided through the interaction a post-nip portion of the belt with the external pressure roll contacting the outer surface of the belt.

The thicknesses as well as other characteristics such as ShoreA hardness on the internal pressure member and the deformable layer(s) of the belt are such that high-speed color fusing as discussed above is enabled. To this end, the aforementioned layers are sandwiched between the two pressure engageable members to provide a fusing nip that is sufficiently long to provide the desired high speed fusing. With such a nip a very low creep is inherent, creep being defined as the % velocity difference of the fuser belt surface in the fusing nip compared to its speed outside the nip or in the post-nip area. Substrate stripping presents a problem with such a configuration. Thus, in order to effect self-stripping, a portion of the belt is partially wrapped, in the post-nip region, around the external pressure roll engaging the external surface of the belt. The result of such post-nip wrapping is to compress the surface of the belt in that area thus decreasing the belt speed compared to a non-wrapped belt or an IPR wrapped belt in the post-nip area so that there is sufficient creep to effect stripping of imaged substrates. One of the rolls supporting the belt for movement in an endless path is positioned relative to the external pressure roll such that the post-nip wrapping is accomplished.

DESCRIPTION OF THE DRAWINGS

FIG. 3 is a table of belt and fuser nip configurations illustrating values for creep, paper edge wear or abrasion, paper stripping and belt life.

DESCRIPTION OF THE INVENTION

Figure 1:
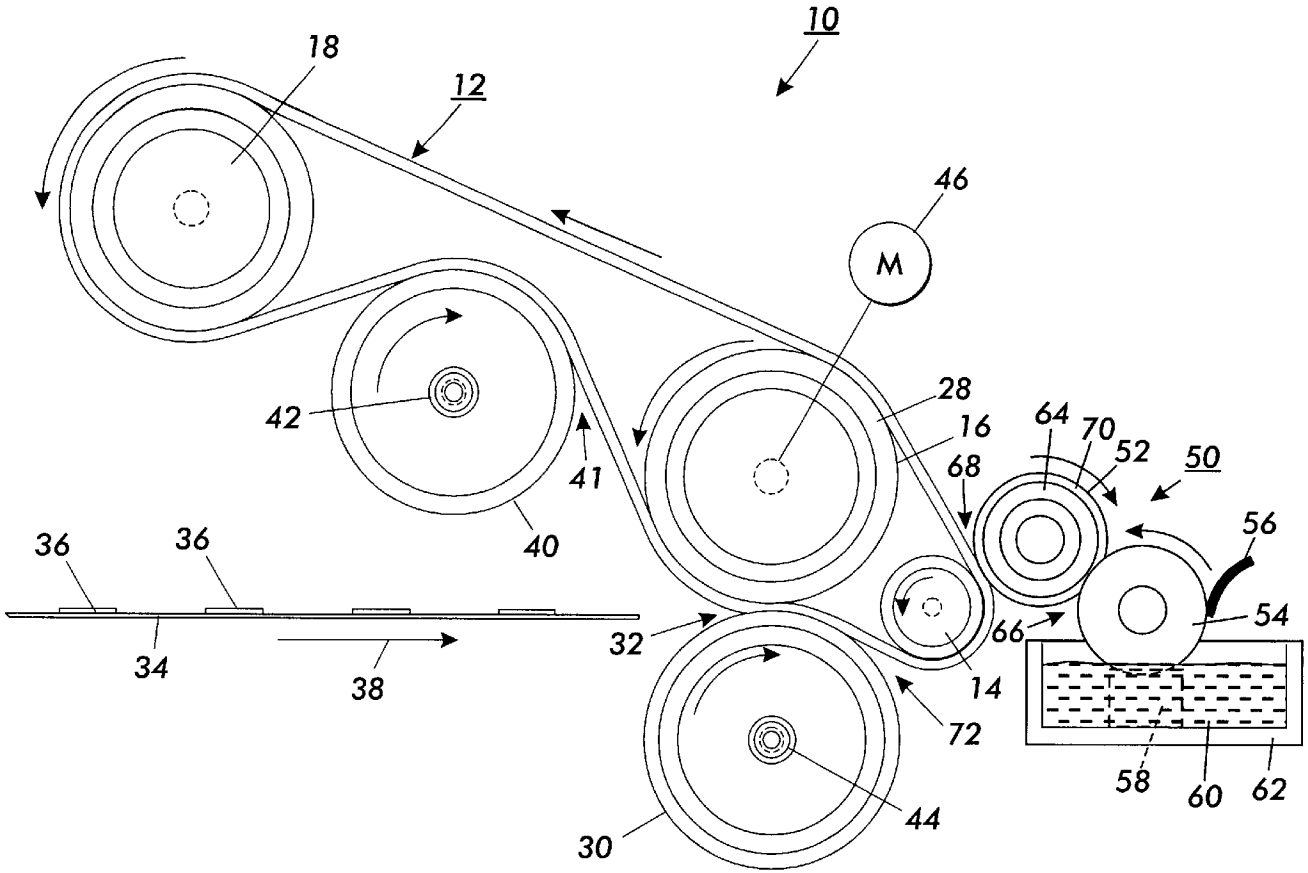
FIG. 1 is a schematic representation of a high-speed heat and pressure belt fuser according to the invention.

There is provided a high-speed heat and pressure belt fuser including a pair of pressure rolls and an externally heated, thick elastomeric fusing belt. The pressure engageable rolls and belt are supported such that the belt is sandwiched between the two pressure rolls. The belt is supported by a plurality of rolls one of which is one of the pressure rolls. The belt and the pressure engageable roll about which the belt is looped are each provided with one or more deformable layers which cooperate to form a single elongated nip through which substrates carrying toner images pass with the toner images contacting the outer surface of the elastomeric belt. An external source of heat is provided for contacting the outer surface of the belt in a pre-nip area.

The external heating allows for maximum elastomer temperatures to be attained at the fusing surface without relying on heat transfer through the belt. Externally heating the belt enables larger belt thicknesses allowing for increased nip widths necessary for higher process speeds without image gloss degradation while exhibiting long life and minimal edge wear. Higher fusing surface temperatures also enable the use of high melting temperature toners as well as the use of large toner pile heights. Therefore, the belt can be used for fusing color toner images as well as black toner images.

Although increasing elastomer thickness would normally be expected to result in fuser "droop", the present invention allows for a reduction in the "droop" of the fuser to little or no droop. Droop is defined as the reduction in Fuser Roll (FR) surface temperature over time as a function of contact with ambient media and/or a cooler Pressure Roll (PR). With internally heated roll fusers, especially rolls with thick rubber layers, the droop can be significant because of the time it takes to heat through the bulk of the rubber after the paper and pressure roll (PR) start drawing heat from the FR. The effects of droop lead to poor image fix and gloss within a series of prints. The external heating of the belt replenishes the heat quickly at the belt surface prior to the belt re-entering the fusing nip, thereby eliminating the time lag caused by heating through the rubber, in the case of a roll fuser.

The belt also has the potential of being more environmentally friendly since only the rubber needs to be replaced when the fusing surface of the belt reaches its useful life.

For a general understanding of the features of the present invention, reference is made to the drawings, in which, like reference numerals have been used throughout to identify identical elements.

Figure 8:
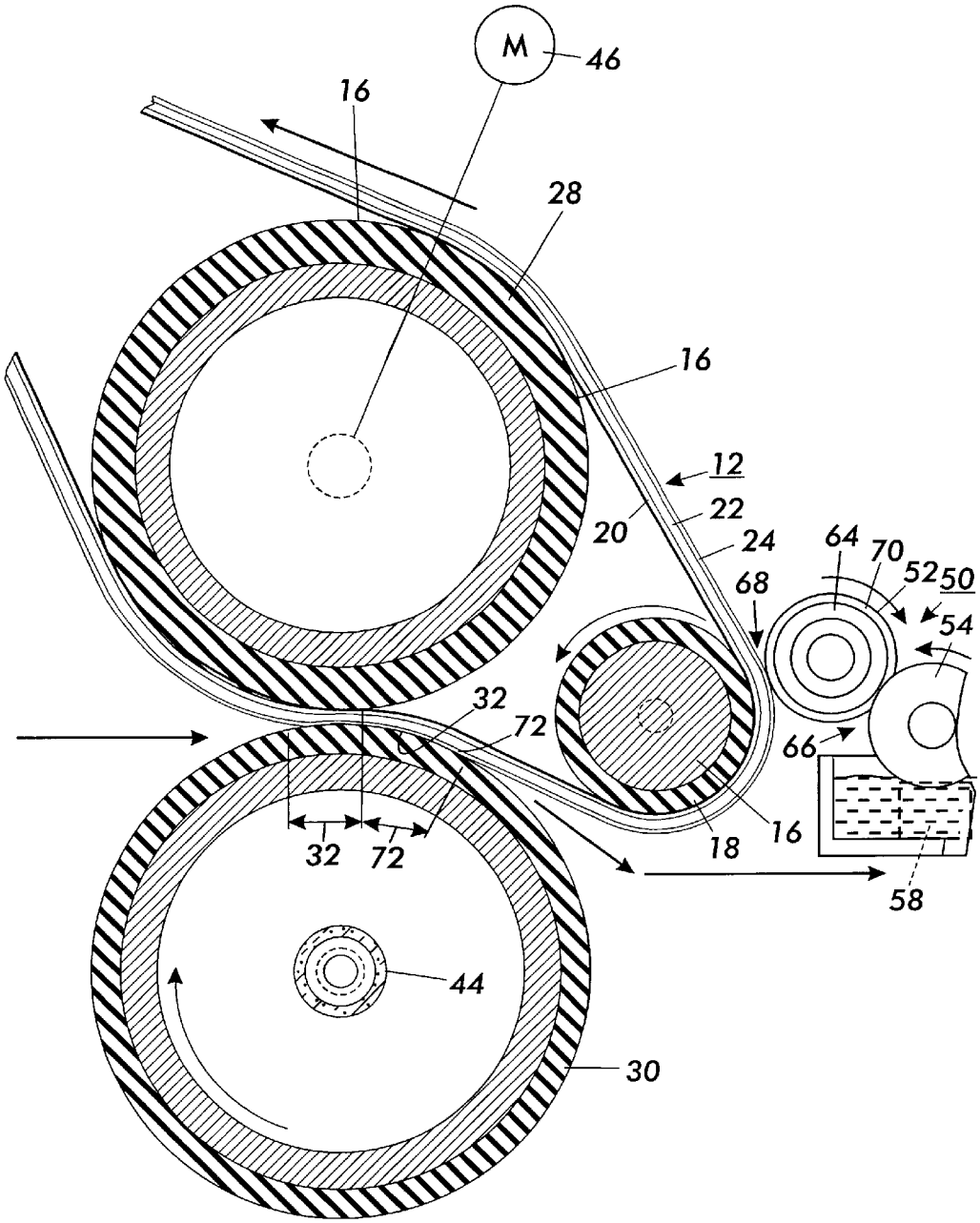
FIG. 8 is a fragmentary schematic view of the belt fuser of FIG. 1 illustrating the three-layer structure of the belt.

As disclosed in FIG. 1, one embodiment of the present invention comprises a high-speed (i.e. over 100 pages per minute (ppm)) heat and pressure belt fuser indicated generally by the reference character 10. An elastomeric belt structure 12 is supported for movement in an endless path by a plurality of support rolls 14, 16 and 18. By way of example, the belt structure 12 is a three-layered arrangement comprising a base layer 20, a middle layer 22 and an outer layer 24 (FIG. 8). The base or substrate layer 20 is a relatively thin member fabricated in a well-known manner from a suitable internally reinforced fabric utilized for this purpose. The substrate can be a polyimide such as a polyamide imide woven fabric such as NOMEX®, available from DuPont. The middle layer 22 is a conformable layer of, for example, silicone rubber. The outer layer, also by way of example, is a conformable material such as Viton™ 1198 having a thickness of about 40 $\mu$m. The outer layer may also comprise a solid silicone material such as polydimethylsiloxane. As an example, the belt structure 12 may have a width of 410 mm and an overall length of 725 mm. The total thickness of the belt structure is in the order of 3 to 5 mm. The middle layer 22 provides substantially the entire thickness of the belt structure. The durometer of the belt structure is in the order of 35 to 80 ShoreA with 40 to 60 ShoreA being preferred. The base layer 20 has a thickness of about 10 mils and represents less than 20% of the total belt thickness.

Roll 16 is an Internal Pressure Roll (IPR), in that it is supported for contact with the inner surface of the base layer 20 of the elastomeric belt 12. The IPR 16 which, by way of example, has an outside diameter of 94 mm, is provided with a conformable outer layer 28 that has preferably a thickness of about 15 mm and has a Shore A value from about 35 ShoreA to about 80, preferably in the order of 45 to 70 ShoreA.

Roll 18 provides suitable tensioning of the elastomeric belt and is gimbaled in a well-known manner, not shown, for effecting proper steering thereof.

A second pressure roll 30 is supported such that the elastomeric belt 12 is sandwiched between it and the IPR 16 in order to form an elongated, fusing nip 32. Thus, the roll 30 constitutes an External Pressure Roll (EPR). The conformable layers of the belt structure 12 and the IPR 16 cooperate to form the nip 32. In order to obtain the desired high speed fusing, a large nip length is required which inherently has a low creep. Creep is defined as the % velocity difference of the fuser belt surface in the fusing nip compared to its speed outside the nip. A low creep nip presents a problem for substrate stripping which is dealt with in a manner to be discussed hereinafter.

Imaged substrates such as a sheet of plain or coated paper 34 carrying toner images 36 moving in the direction of arrow 38 pass through the nip 32 with the toner images contacting an outer surface of the outer layer 24 of the belt structure 12.

The fusing nip 32 comprises a single nip in that the section of belt contacted by the IPR roll 16 is coextensive with the opposite section of the belt contacted by roll 30. In other words, neither of the rolls 16 and 30 contact a section of the belt not contacted by the other of these two rolls. A single nip insures a single nip velocity and high pressure through the entire nip.

The layers 22 and 24 of the elastomeric belt structure 12 are elevated to fusing temperature by means of an internally heated roll 40 having a conventional quartz heater 42 disposed internally thereof. The roll 40 which by way of example has a diameter of 87 mm comprises a relatively thin (0.050 to 0.5 inch) walled metal structure chosen for its good thermal transfer properties. To this end, the roll 40 may be fabricated from metal such as aluminum, stainless steel, or the like and can either be anodized and/or overcoated with a thin (about 1 to about 4 mils) conductive perfluoroalkoxy (PFA). The roll 40, as shown in FIG. 1, contacts the outer surface of the belt structure in a pre-nip area 41.

The IPR 16 is not provided with an internal heat source, because it is not practical to do so. However, another quartz heating element 44 may be disposed internally of the EPR 30 for providing thermal energy during fuser warm-up and/or on an as needed basis. By supplying additional heat to roll 30 during extended runs with heavy paper, the phenomenon commonly referred to as droop is decreased or eliminated.

A motor 46 operatively connected to the IPR roll 16 through a conventional drive mechanism (not shown) provides for rotation of the roll 16. The frictional interface between the elastomeric belt 12 and the roll 16 imparts movement to the belt structure 12 and the friction developed between the belt structure 12 and the rolls 16, 40, 30 and 18 cause those rolls to be driven by the belt structure 12. Separate drive mechanisms (not shown) may be provided where necessary for imparting motion to any or all of the rolls.

For the purpose of preventing toner offset to the heated belt structure 12 there is provided an optional Release Agent Management (RAM) system generally indicated by reference character 50. The mechanism 50 may be of numerous configurations well known in the art and may comprise a donor roll 52, metering roll 54, metering blade 56 and a wick 58. The metering roll 54 is partially immersed in release agent material 60 and is supported for rotation such that it is contacted by the donor roll 52 which is supported so as to contact the fusing belt structure 12. The release agent material is, by way of example, can be either functional or non-functional silicone oil. As can be seen, the orientation of the rolls 52 and 54 is such as to provide a path for conveying material 60 from a sump 62 to the surface of the belt. In order to permit rotation of the metering roll 54 at a practical input torque to the belt structure 12, the donor roll 52 may comprise a deformable or conformable layer 64 which forms a first nip 66 between the metering roll and the donor roll and a second nip 68 between the latter and the belt. The nips 66 and 68 also permit satisfactory release agent transfer between the rolls and the belt.

Wick 58 is fully immersed in the release agent and contacts the surface of the metering roll 54. The purpose of the wick is to provide an air seal that disturbs the air layer formed at the surface of the metering roll 54 during rotation thereof. If it were not for the function of the wick, the air layer would be coextensive with the surface of the roll immersed in the release agent thereby precluding contact between the metering roll and the release agent.

The blade 56 functions to meter the release agent picked up by the roll 54 to a predetermined thickness, such thickness being of such a magnitude as to result in several microliters of release agent consumption per copy. The deformable layer 64 of the donor roll may comprise silicone rubber. However, other materials may also be employed.

A thin sleeve 70 on the order of several mils constitutes the outermost surface of the roll 52. The sleeve material comprises TEFLON®, VITON® or any other material that will impede penetration of silicone oil into the silicone rubber. While the donor rolls may be employed without the sleeve 70, it has been found that when the sleeve is used, the integrity of the donor roll is retained over a longer period and contaminants such as lint on the belt will not readily transfer to the metering roll 54. Accordingly, the material in the sump will not become contaminated by such contaminants.

The thicknesses of the elastomers on both the internal pressure roll (IPR) and the fuser belt as well as the durometer thereof contribute to the characteristics of the fusing nip. The thickness and the durometer of both elastomers can be varied to obtain the desired dwell times in the fusing nip. The problem is that adequate creep (>5%) needs to be maintained for intrinsic paper stripping. Creep is defined as the % velocity difference of the fuser belt surface in and outside the fusing nip.

Figure 2:
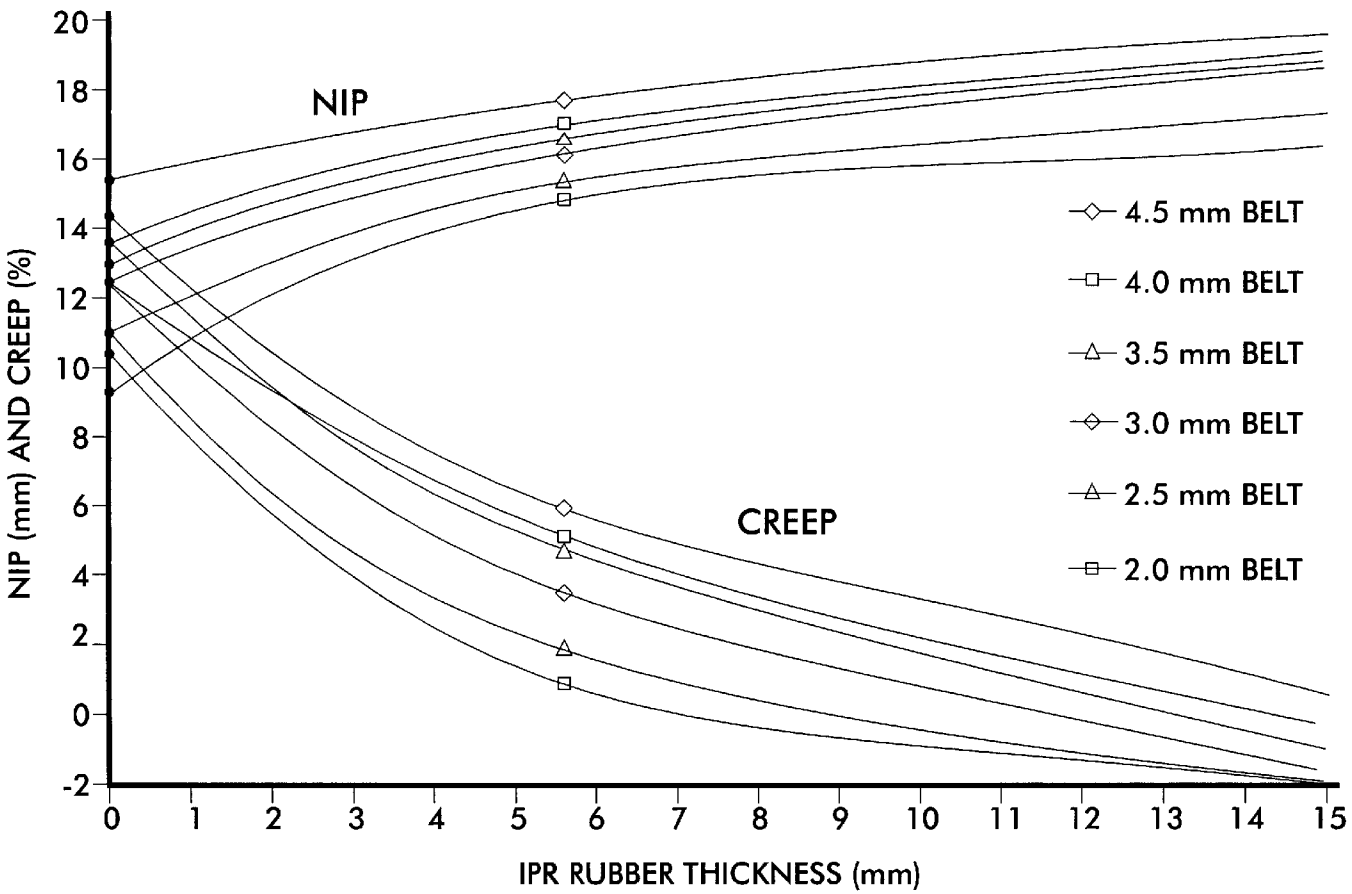
FIG. 2 depicts measured creep and nip values for various belt fusers. Nip and creep values are plotted versus Internal Pressure Roll (IPR) rubber thickness.

The fusing nip length is strongly dependent on the IPR rubber thickness. Maximum creep is obtained with no rubber on the IPR and all the rubber on the belt. A very large nip width is obtained by making the IPR rubber very thick but this results in very low creep and makes paper stripping difficult without some modification of the fuser structure 10. For example the use of 15 mm IPR and 3 mm belt rubber (ShoreA=45) results in a measured creep of approximately −2% (see FIG. 2). Softer IPR rubber does not significantly change this low level of creep. The most efficient way to increase the creep is to minimize the IPR rubber thickness and increase the belt rubber thickness as much as possible. FIG. 2 also shows other combinations of belt and roll layer thicknesses. On the other hand, FIG. 2 and also FIG. 3 depict belt and roll configurations that do not result in low creep and the inherent lack of stripping. However, configurations that provide higher creep values suffer from inadequate fix, low gloss image, excessive edge wear and shorter belt life.

The length of the fusing nip also depends on the pressure exerted in the nip but for nominal pressure of 100+/−15 psi the change in nip width is small. The nip length varies over a range of values in the order of 19 to 21 mm.

FIGS. 2 and 3 illustrate the experimentally determined creep and nip relationships for belt fusers with the IPR being provided with a conformable outer layer. As shown therein, the use of a conformable layer on the IPR enlarges the nip beyond what can be obtained with the belt rubber alone. So if a 1% creep is required to prevent gloss change due to paper edge abrasion this can be achieved with a 15 mm IPR rubber coating (ShoreA=45) and a 3.5 mm belt thickness (ShoreA=48). This elastomer combination will result in a 19 mm nip that has substantial process speed extensibility. FIGS. 2 and 3 show that other combinations of belt and roll rubber thicknesses and durometer are possible but some of these combinations are not desirable for one reason or another.

FIG. 3 shows a number of IPR and Belt rubber combinations and nip characteristics. The first nip design in FIG. 3 has 15 mm of IPR rubber and a 3 mm thick belt that results in a very large nip. This is good for high speed fusing but has essentially no creep and consequently will not strip paper although the edge wear is low, belt life is longer and toner images fused with this configuration exhibit high gloss. The second nip design in FIG. 3 has no IPR rubber and a 3 mm belt resulting in a nip that is very small and has a very high creep. This combination is not suitable for high speed fusing. It will strip paper very well but will have high edge wear and result in early belt failure due to high internal strain energy. The third nip configuration in FIG. 3 uses a thicker belt that will increase the nip length but the creep is undesirably high resulting in high edge wear and premature belt failure. The fourth, fifth and sixth configurations yield good stripping but fall short of meeting the desired goals of the present invention. For example, the sixth configuration results in a fuser with a maximum speed of 100 ppm and one that does not have acceptable edge wear. The speeds of configurations four and five are greater than that provided by configuration six but like that configuration do not meet with acceptable edge wear requirements. Also, belt life is less than desired.

Figure 4:
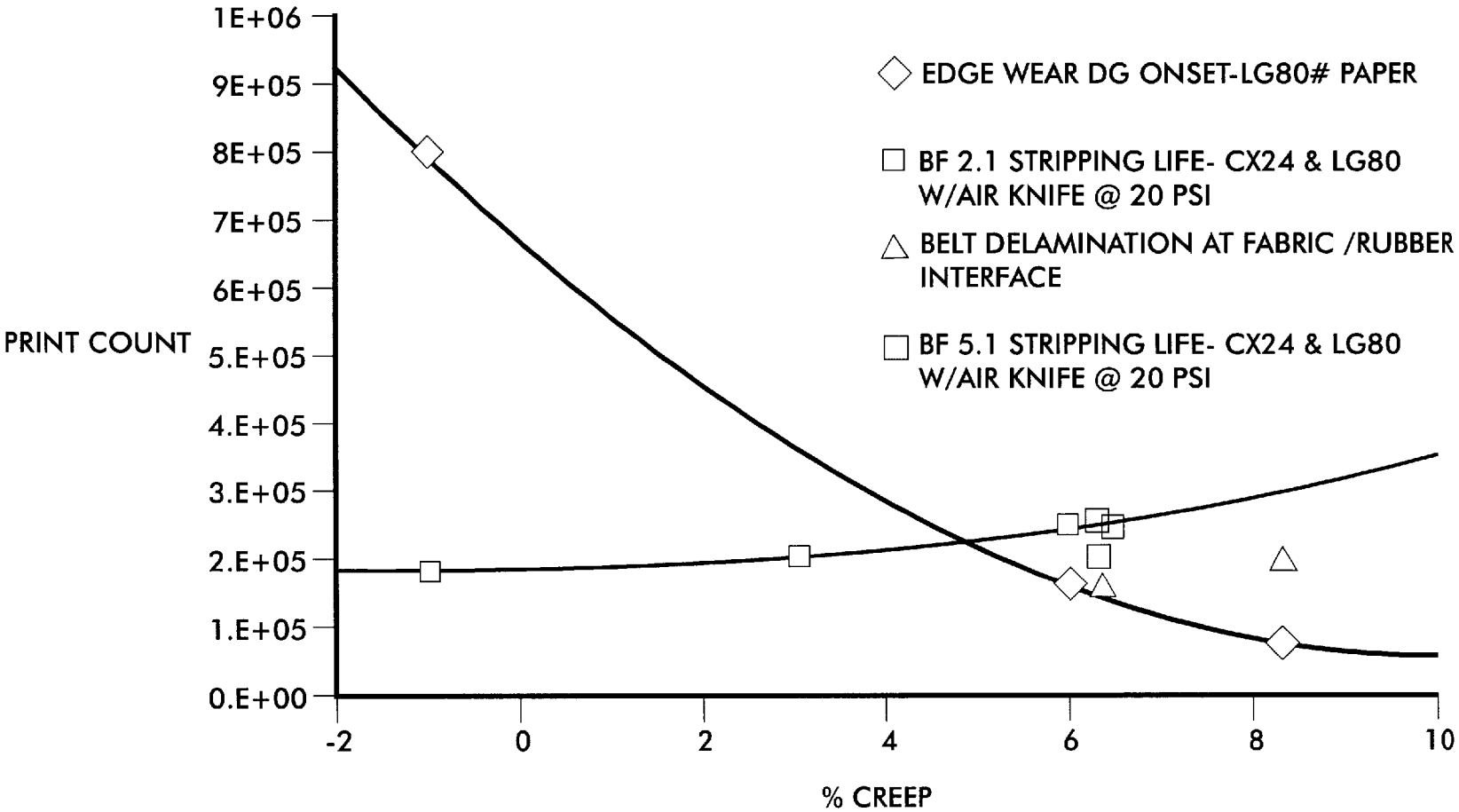
FIG. 4 is a graph of print count versus creep that illustrates that when creep is high edge wear is also high and stripping and belt life are better.

FIG. 4 shows that there is no gloss change due to paper edge wear up to 800,000 prints for a low creep (−1%) nip configuration. The difference in gloss due to paper edge abrasion for high and low creep, fusing nips is shown by the curve in FIG. 4.

Figure 5:
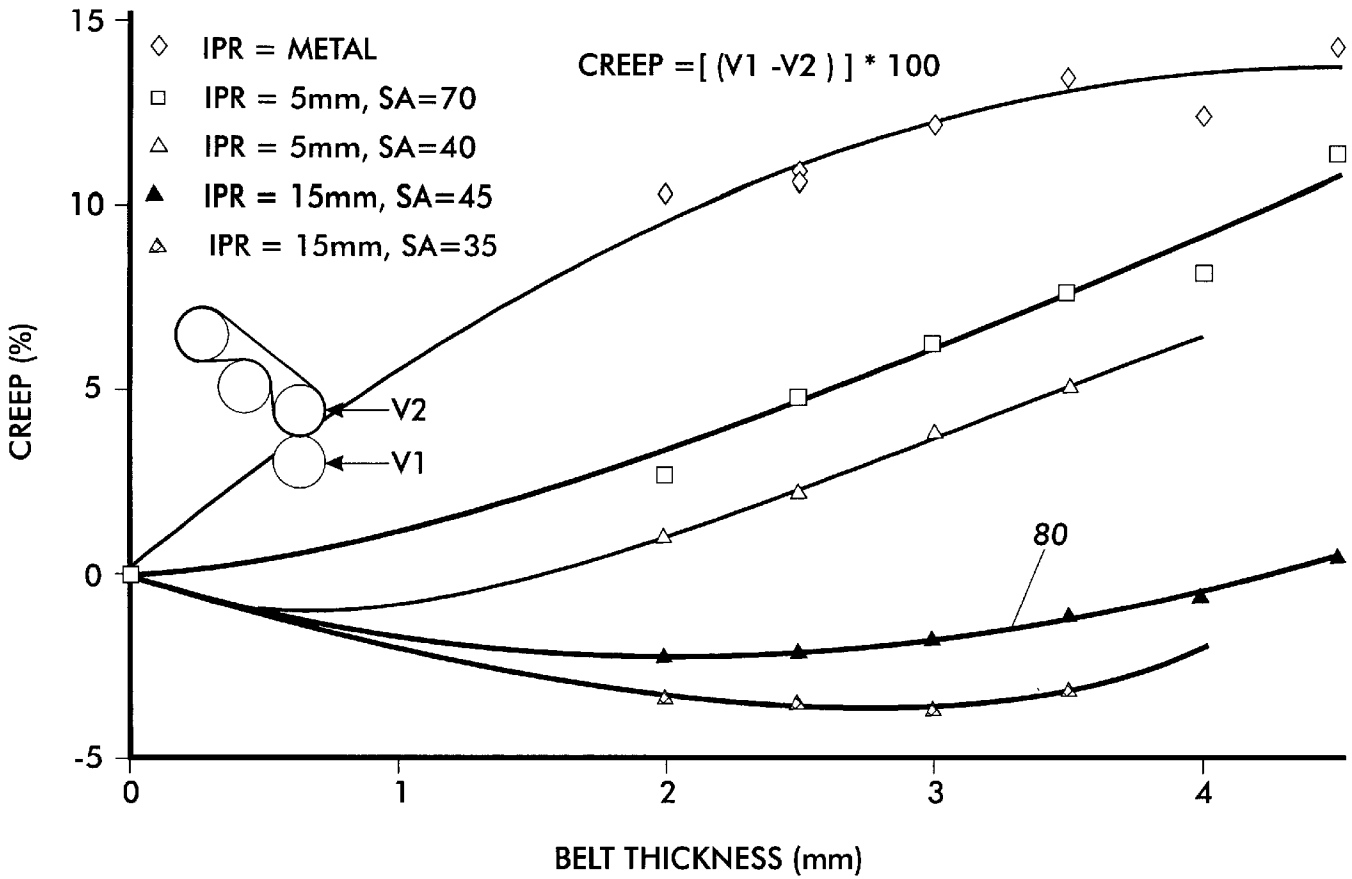
FIG. 5 is a plot of creep vs. belt thickness that shows that creep varies with different combinations of belt and IPR deformable layers and that the larger the combined thickness the lower the creep.

FIG. 5 is a plot of creep vs. belt thickness that shows that creep varies with different combinations of belt and IPR deformable layers and that the larger the IPR rubber thickness the lower the creep. For example, as shown in FIG. 5, curve 80 illustrates that for an IPR deformable layer 15 mm thick in combination with a belt thickness of about 3.5 the creep is about −1%.

Figure 6:
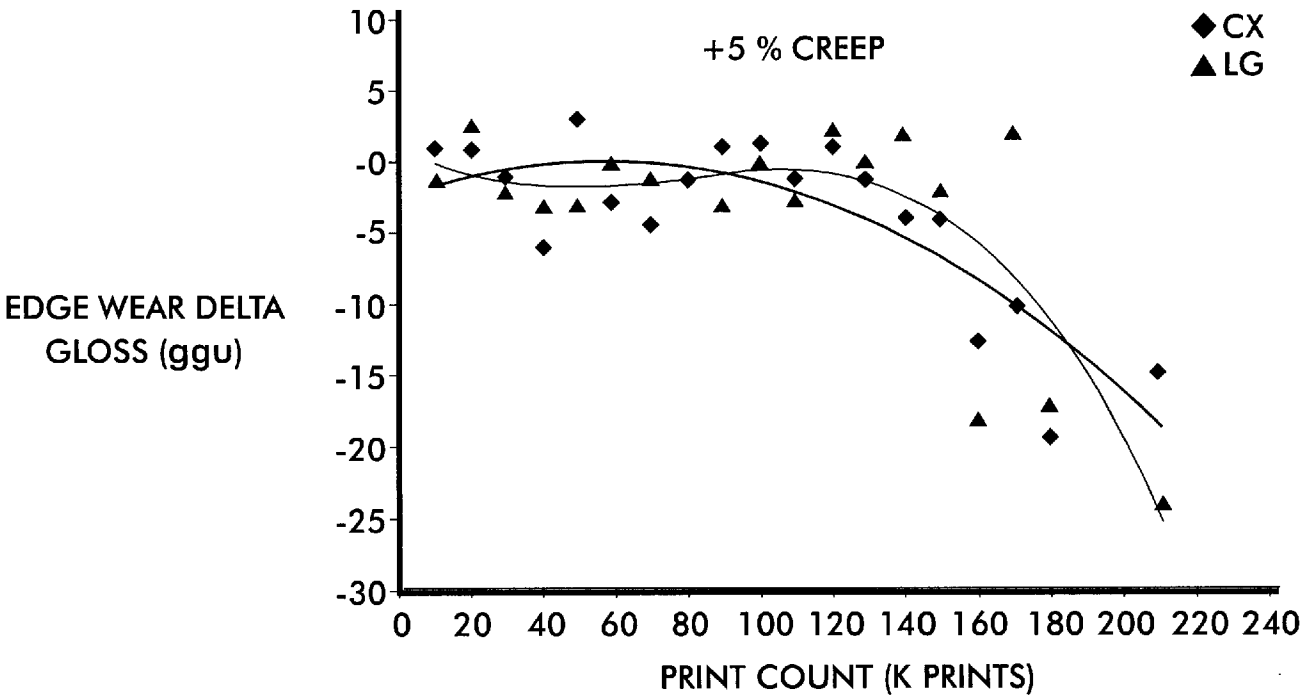
FIG. 6 is a plot of edge wear delta gloss versus print count illustrating gloss change due to a relatively high creep value.
Figure 7:
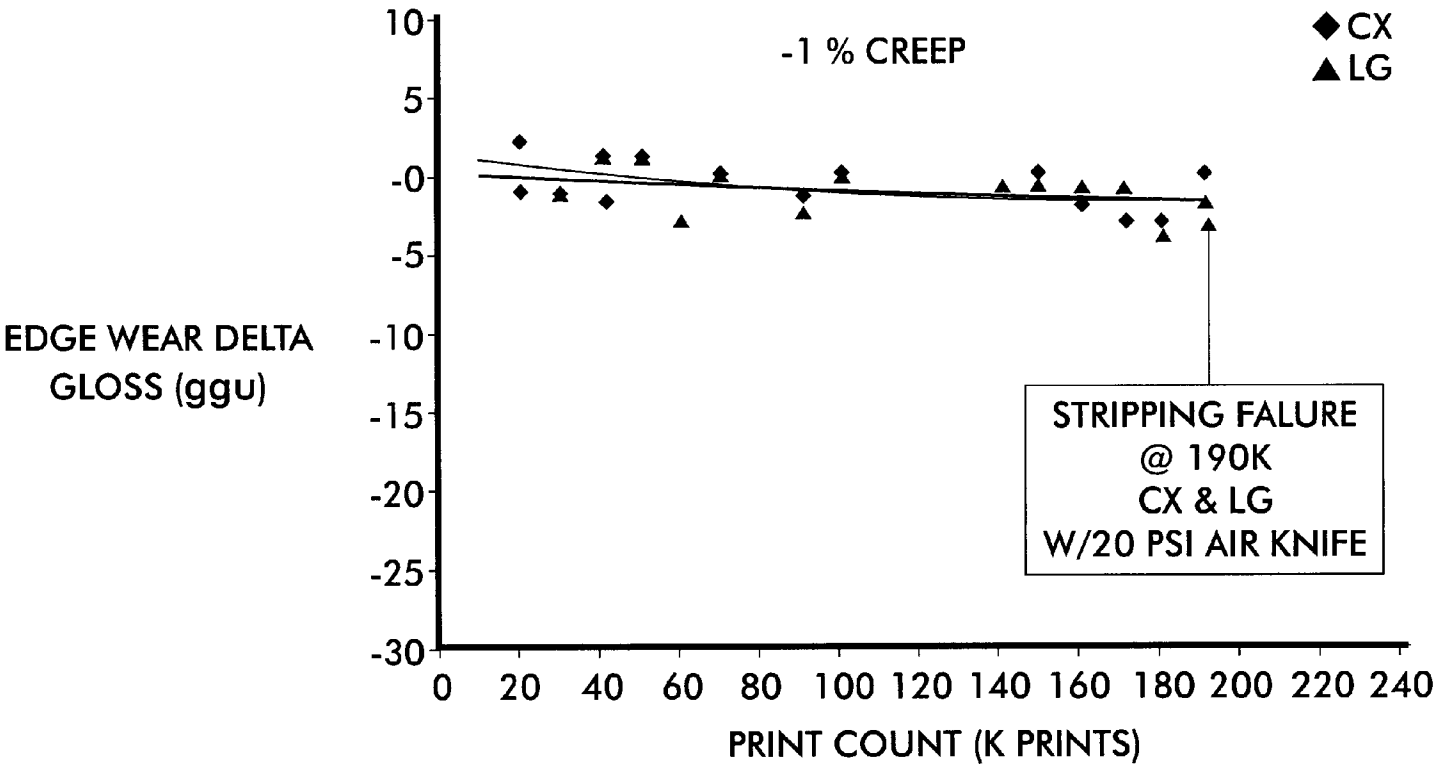
FIG. 7 is a plot of edge wear delta gloss versus print count illustrating that for a low creep value there is substantially no change in print gloss.

The curves shown in FIGS. 6 and 7 illustrate that image gloss in the edge wear region of the belt varies with creep and that the image gloss is degraded when the creep is high and that image gloss is maintained high when the creep is low.

To attain the desired high speed fusing, the belt thickness and the thickness of the conformable layer on the Internal Pressure Roll (IPR) together with the ShoreA hardness of the belt and conformable layers are chosen so as to provide a large nip such as the first configuration illustrated in FIG. 3. A suitable pressure exerted by conventional means, not shown, is provided for creating the large or elongated nip. When the desired high speed is attained with the forgoing arrangement the creep is low resulting in a fuser wherein stripping is a problem.

To solve the stripping problem, the belt 12 is, in post-nip area 72, wrapped about the External Pressure Roll (EPR) (FIG. 8) to compress (shorten) the surface of the belt in that area thus decreasing the belt speed over a non-wrapped or IPR wrapped belt in the post-nip area so that there is sufficient creep to effect stripping of imaged substrates. Thus, the functions of fusing and stripping are separated enabling the formation of a large nip for high speed fusing and reliable stripping with the addition of a post-fusing nip EPR wrap by the fuser belt to provide the creep that produces inherent stripping.

The internal pressure roller 16 may comprise a metal roller, or may have an outer elastomeric layer thereon. Examples of suitable elastomers for the internal pressure roller layer include silicone rubbers, fluoroelastomers such as VITON®, and the like. The thickness of the internal pressure roll elastomer layer is in the order of 10 to 20 mm. The durometer of the elastomer middle layer 22 is from about 35 ShoreA to about 80, preferably in the order of 45 to 70 ShoreA.

The external pressure roller 30 may be a metal roller, and may comprise an outer layer 21 thereon. Such an optional outer layer may be anodized aluminum or be comprised of a plastic material such as a fluoropolymer, for example, TEFLON®, or the like plastics where high thermal conductivity is preferred. The outer layer of the external pressure roller may have a thickness of from about 1 to about 4 mils, or from about 2 to about 3 mils.

Nip characteristics of IPR and belt rubber combinations are shown in FIG. 3. The first nip configuration in FIG. 3 had 15 mm of IPR rubber and a 3 mm thick belt that resulted in a very large nip (about 19 mm). This was shown to be good for high speed fusing, but had essentially no creep (about −1.7%) and consequently would not strip paper. However, paper edge abrasion is low. Alternate nip configurations, not shown in FIG. 3, can be constructed with even larger nips for higher speed operation. Based on the plots in FIG. 2 one possible higher speed configuration would use a 15 mm IPR rubber with a 4.5 mm belt thickness. Such a configuration would have a nip width of 20 mm, a +1% creep, a speed rating of 667 mm/sec and a paper throughput rating of 143 PPM with nip attributes similar to those for the first configuration shown in FIG. 3.

The second nip design in FIG. 3 had no IPR rubber and a 3 mm belt. The resulting nip was small (about 12 mm) and had very high creep (about 12%). This combination is not suitable for high speed fusing because although paper would strip very well, high paper edge abrasion resulted, along with early belt failure due to high internal strain energy.

The third nip configuration in FIG. 3 used a thicker belt of about 4.5 mm, which increased the nip width to about 17 mm, but the creep was too high (about 11.3%) and resulted in early belt failure.

The fourth, fifth and sixth nip configurations shown in FIG. 3 utilized a 4.5 mm belt and a 7 mm IPR rubber thickness that provided a fairly large nip (18 mm) with medium creep of 5% and medium edge wear. Pursuant to the present intents and purposes of the present invention, the first configuration and variants around this design yields the optimum in three of the four fuser attributes considered critical to high-speed color fusing. Thus, of the four fuser attributes, only stripping is not acceptable but this is independently controlled by the post nip EPR wrap of the fuser belt. The first configuration in FIG. 3 and variants around this design yields a longer nip, thus higher speeds than the other configurations and results in low edge wear and long life.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. A high-speed heat and pressure belt fuser structure, said belt fuser structure comprising:

an endless belt comprising at least one conformable layer;

a plurality of rolls positioned internally of said belt for supporting movement of said belt in an endless path, one of said rolls comprising an internal pressure roll contacting an inner surface of said belt;

an external pressure roll supported for contact with an outer surface of said belt such that said belt is sandwiched between said internal and external pressure rolls, one of said pressure rolls including at least one conformable layer;

an external source of thermal energy for elevating the surface temperature in a pre-nip area of said belt means for effecting pressure engagement of said rolls whereby an elongated nip is formed through which imaged substrates pass with toner images carried thereby contacting said outer surface of said belt;

said conformable layers having a combined thickness and hardness that provides said elongated nip for fusing said toner images with minimal gloss degradation and belt edge wear and without causing premature belt failure;

said belt and one of said pressure members cooperating in a post-nip area for effecting stripping of said substrates; and said at least one conformable layer of said endless belt having a thickness in order of 3 to 5 mm and said at least one conformable layer of said one of said pressure rolls having a thickness in the order of 10 to 15 mm.

2. A high-speed heat and pressure belt fuser structure according to claim 1 wherein said one of said pressure rolls comprising a conformable layer is disposed internally of said belt such that it contacts an inner surface of said belt.

3. A high-speed heat and pressure belt fuser structure according to claim 2 wherein said one of said pressure members comprises one of said rolls supporting said belt for movement.

4. A high-speed heat and pressure belt fuser structure according to claim 2 wherein one of said rolls for supporting said belt for movement is positioned for enabling said belt to cooperate with said one of said pressure members for effecting stripping of said substrates.

5. A high-speed heat and pressure belt fuser structure according to claim 4 wherein said roll that is positioned for cooperating with said one of said pressure members for effecting stripping of said substrates is supported beyond said post-nip area whereby a portion of said belt is wrapped about said pressure roll contacting said outer surface of said belt to compress the surface of the belt in that area thus decreasing the belt speed compared to a non-wrapped or IPR wrapped belt in the post-nip area so that there is sufficient creep to effect stripping of imaged substrate.

6. A high-speed heat and pressure belt fuser structure according to claim 4 wherein said belt has a thickness in the order of 3 to 5 mm and said at least one conformable layer of said one of said pressure rolls has a thickness in the order of 10 to 20 mm.

7. A high-speed heat and pressure belt fuser structure according to claim 6 wherein said conformable layers have a ShoreA hardness in the order of 35 to 80.

8. A high-speed heat and pressure belt fuser structure according to claim 7 wherein said nip has a length in the order of 19 to 21 mm.

9. A high-speed heat and pressure belt fuser structure according to claim 8 wherein said nip has a creep in the order of −2 to +2%.

10. A high-speed heat and pressure belt fuser structure according to claim 9 wherein a pressure of about 80 psi is applied between said pressure rolls for forming said elongated nip.

11. A high-speed heat and pressure belt fuser structure according to claim 1 wherein said one of said pressure members comprises one of said rolls supporting said belt for movement.

12. A high-speed heat and pressure belt fuser structure according to claim 1 wherein one of said rolls for supporting said belt for movement is positioned for enabling said belt to cooperate with said one of said pressure members for effecting stripping of said substrates.

13. A high-speed heat and pressure belt fuser structure according to claim 1 wherein said conformable layers have a ShoreA hardness in the order of 35 to 80.

14. A high-speed heat and pressure belt fuser structure according to claim 1 wherein said nip has a length of about 19 to 20 mm.

15. A high-speed heat and pressure belt fuser structure according to claim 14 herein a pressure of about 80 psi is applied between said pressure rolls for forming said elongated nip.

16. A high-speed heat and pressure belt fuser structure according to claim 1 wherein said nip has a creep in the order of −2 to +2%.

* * * * *